US011349248B2

(12) United States Patent
Huang et al.

(10) Patent No.: US 11,349,248 B2
(45) Date of Patent: May 31, 2022

(54) UNIVERSAL SERIAL BUS CONNECTOR

(71) Applicant: Advanced Connectek Inc., New Taipei (TW)

(72) Inventors: Er Li Huang, New Taipei (TW); Pin-Yuan Hou, New Taipei (TW); Yao Mei Wang, New Taipei (TW); Hsien-Lung Huang, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 17/099,786

(22) Filed: Nov. 17, 2020

(65) Prior Publication Data

US 2021/0151924 A1 May 20, 2021

(30) Foreign Application Priority Data

Nov. 18, 2019 (CN) ..... 201921988434.1

(51) Int. Cl.
*H01R 13/50* (2006.01)
*H01R 13/26* (2006.01)

(52) U.S. Cl.
CPC ..... *H01R 13/50* (2013.01); *H01R 13/26* (2013.01)

(58) Field of Classification Search
CPC ..... H01R 13/50; H01R 13/26; H01R 13/46; H01R 13/02; H01R 13/00
USPC ..... 439/660
See application file for complete search history.

(56) References Cited

U.S. PATENT DOCUMENTS

| | | | | |
|---|---|---|---|---|
| 8,393,920 | B2 * | 3/2013 | Yu | H01R 24/62 439/660 |
| 9,331,421 | B2 * | 5/2016 | Lai | H01R 13/405 |
| 9,337,588 | B2 * | 5/2016 | Chang | H01R 13/6594 |
| 9,362,682 | B2 * | 6/2016 | Chien | H01R 27/02 |
| 9,450,355 | B2 * | 9/2016 | Zhang | H01R 24/60 |
| 9,525,244 | B1 * | 12/2016 | Hsu | H01R 13/6594 |
| 9,692,166 | B2 * | 6/2017 | Kao | H01R 24/60 |
| 9,972,952 | B2 * | 5/2018 | Guo | H01R 24/60 |
| 10,141,693 | B2 * | 11/2018 | Zhao | H01R 12/727 |
| 10,236,599 | B2 * | 3/2019 | Zhao | H01R 13/6582 |
| 10,971,840 | B2 * | 4/2021 | Tsai | H01R 13/405 |
| 2014/0364013 | A1 * | 12/2014 | Yu | H01R 13/193 439/660 |
| 2015/0340791 | A1 * | 11/2015 | Kao | H01R 13/42 439/676 |
| 2017/0271823 | A1 * | 9/2017 | Zhao | H01R 13/50 |
| 2018/0183188 | A1 * | 6/2018 | Tsai | H01R 13/6585 |

* cited by examiner

*Primary Examiner* — Harshad C Patel
(74) *Attorney, Agent, or Firm* — JCIPRNET

(57) ABSTRACT

The invention provides a universal serial bus connector, including an insulating body and a plurality of terminals. The insulating body has a tongue portion and at least one recess located on the tongue portion. The terminals pass through the insulating body, and the terminals expose the insulating body from the tongue portion. The recess corresponds to at least one terminal and is located in an extending direction of the corresponding terminal on the tongue portion.

15 Claims, 4 Drawing Sheets

UNIVERSAL SERIAL BUS CONNECTOR

CROSS-REFERENCE TO RELATED APPLICATION

This application claims the priority benefit of China application no. 201921988434.1, filed on Nov. 18, 2019. The entirety of the above-mentioned patent application is hereby incorporated by reference herein and made a part of this specification.

BACKGROUND OF THE INVENTION

Field of the Invention

The invention relates to a connector, particularly a universal serial bus connector.

Description of Related Art

With the development of science and technology, a variety of connectors for different electronic products have emerged. USB connectors are one of the most widely used and popular connectors among electrical connectors. Most electronic equipment are provided with USB connectors. At present, the USB TYPE-C connector is widely used as a connector that may realizes positive and negative insertion, but even so, related USB connectors still have related defects as described later.

Generally speaking, USB connectors include flat terminals and elastic terminals, but they are often readily damaged due to misuse of other connectors that do not conform to specifications. Furthermore, after long-term plugging and unplugging, in addition to foreign objects, metal debris are also produced at the surface of the terminals due to long-term friction. Moreover, once the foreign objects or metal debris accumulate to a considerable extent, they may occupy the gap between the terminals, causing indirect contact between adjacent terminals, which may cause poor withstand voltage or even short circuits.

SUMMARY OF THE INVENTION

The invention provides a USB connector having a dust collecting area for accommodating foreign objects, so as to improve the tolerance to foreign objects.

A universal serial bus connector of the invention includes an insulating body and a plurality of terminals. The insulating body has a tongue portion and at least one recess located on the tongue portion. The terminals pass through the insulating body, and the terminals expose the insulating body from the tongue portion. The recess corresponds to at least one terminal and is located in an extending direction of the corresponding terminal on the tongue portion.

In an embodiment of the invention, the recess corresponds to a power terminal in the terminals.

In an embodiment of the invention, the universal serial bus connector is a Type-C connector, and the insulating body has a pair of recesses on two opposite surfaces of the tongue portion to correspond to a plurality of power terminals (Vbus) of the Type-C connector.

In an embodiment of the invention, the tongue portion is divided into a first area and a second area along the extending direction of the terminal. The terminal exposes the insulating body from the first area, and the recess is located at a junction of the first area and the second area.

In an embodiment of the invention, the recess is extended from the junction of the first area and the second area toward the second area.

In an embodiment of the invention, the insulating body further has a base portion, and the second area is joined between the base portion and the first area. Each of the terminals passes through the base portion, the first area, and the second area, and a portion of each of the terminals is extended out of the insulating body from the base portion.

In an embodiment of the invention, the tongue portion has two surfaces opposite to each other, the terminals respectively expose the insulating body from the two surfaces, and the insulating body has a plurality of recesses located at the two surfaces, respectively.

In an embodiment of the invention, a plurality of terminals of another universal serial bus connector are respectively adapted to be docked to the terminals along a docking direction, and the recess is located in the docking direction.

Based on the above, the universal serial bus connector is provided with a recess on the tongue portion of the insulating body, and the recess is located in the extending direction of the terminals on the tongue portion. Therefore, when docked with another universal serial bus connector, the debris produced by the friction between the respective terminals may be further pushed into the recess, so that the recess may form a dust collection area for accommodating the debris or foreign objects. In this way, it is possible to prevent these debris or foreign objects from falling on the exposed area of the terminals on the tongue portion, thereby avoiding poor withstand voltage or short circuits of adjacent terminals due to these debris or foreign objects.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
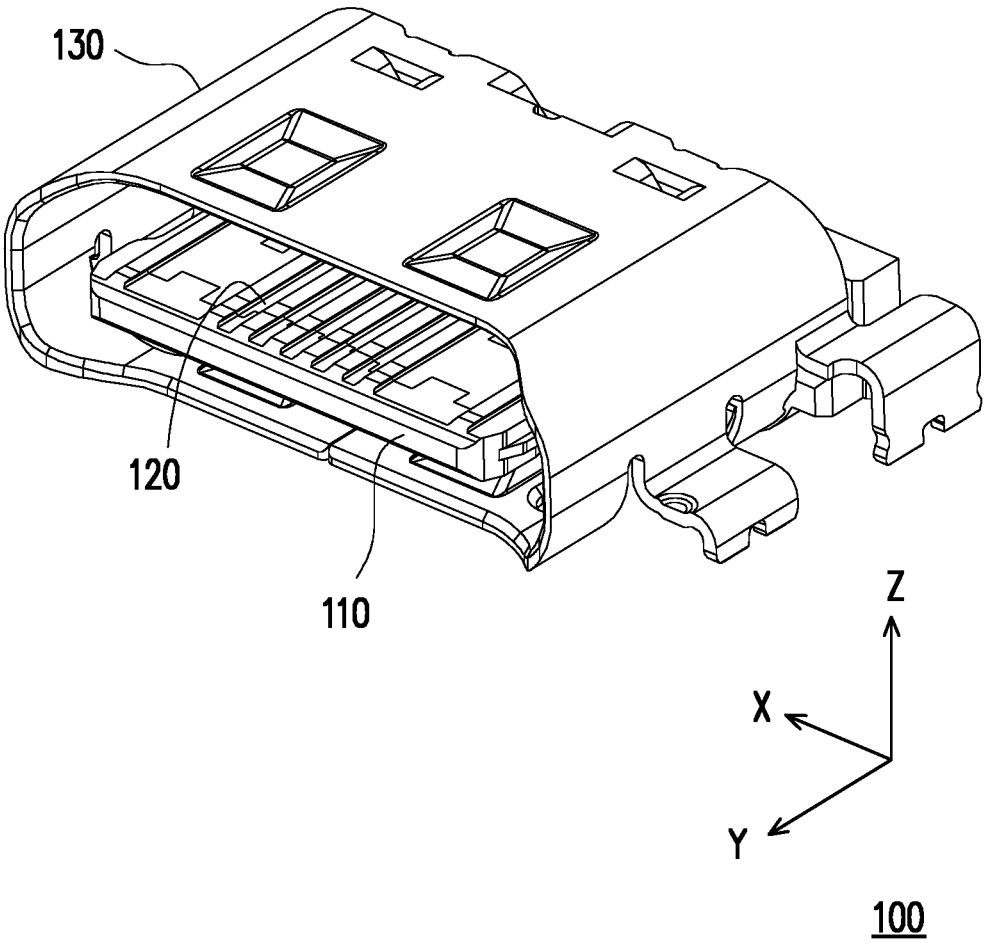
FIG. 1 is a diagram of a USB connector according to an embodiment of the invention.
Figure 2:
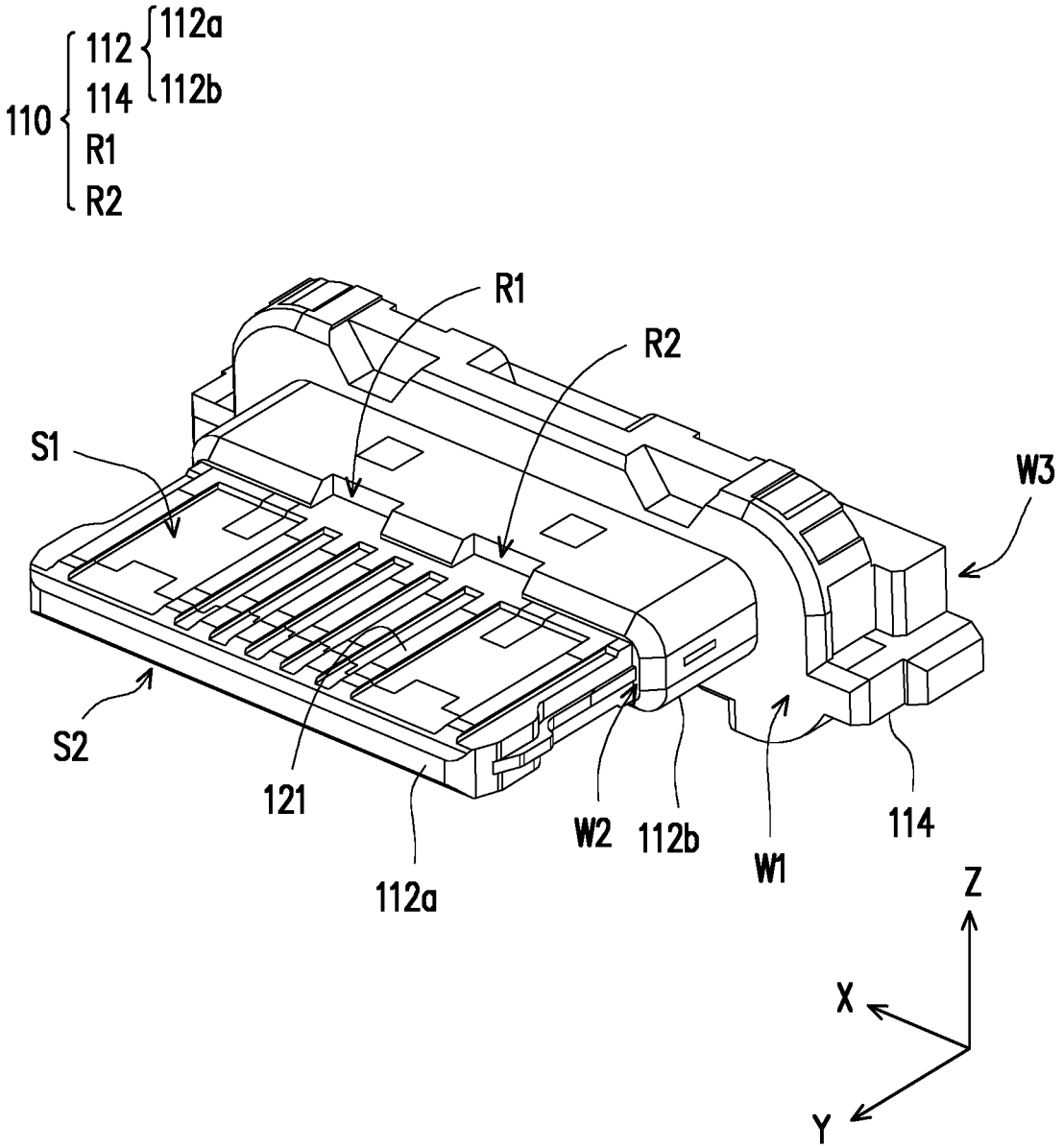
FIG. 2 is a diagram of an internal component of the USB connector of FIG. 1.
Figure 3:
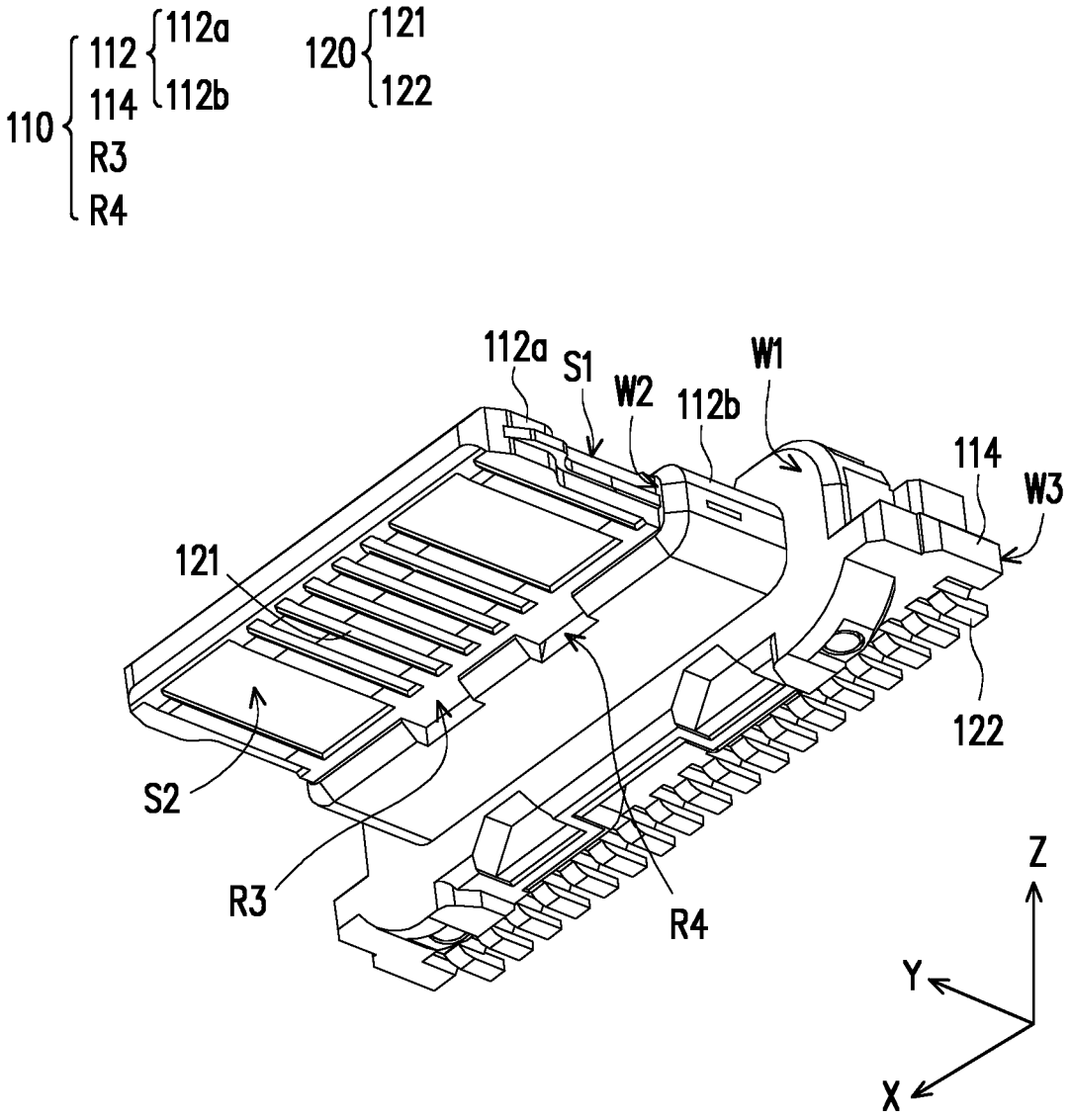
FIG. 3 shows the internal component of the USB connector of FIG. 2 from another perspective view.

FIG. 1 is a diagram of a USB connector according to an embodiment of the invention. FIG. 2 is a diagram of an internal component of the USB connector of FIG. 1. FIG. 3 shows the internal component of the USB connector of FIG. 2 from another perspective view. The present embodiment also provides rectangular coordinates X-Y-Z to facilitate component description. Please refer to FIG. 1 to FIG. 3 at the same time. In the present embodiment, a USB connector 100 includes an insulating body 110, a plurality of terminals 120, and a metallic shell 130. The terminals 120 respectively pass through the insulating body 110 and are retained in the insulating body 110. The metallic shell 130 encloses the insulating body 110 and the plurality of terminals 120. The insulating body 110 includes a base portion 114, a thickened step portion, and a tongue portion 112. The thickened step portion is located on a root region of the tongue portion 112 and adjacent to the base portion 114. At least one recess is formed on a front region of the thickened step portion of the tongue portion 112 (a plurality of recesses R1 to R4 as an example here). Flat portions of the terminals 120 are respectively exposed on an upper surface of the tongue portion 112 and a lower surface of the tongue portion 112. The recesses R1 to R4 respectively correspond to at least one terminal and are located in the extending direction of the corresponding terminals 120 on the tongue portion 112. Here, flat portions of the terminals 120 located on the upper surface of the tongue portion 112 and the lower upper surface of the tongue portion 112 are arranged along the X-axis, each of the terminals 120 is extended along the Y-axis, and the recesses R1 to R4 are respectively formed on the front region of the thickened step portion of the tongue portion 112 along the Y-axis and the Z-axis corresponding to the corresponding terminals 120.

Figure 4:
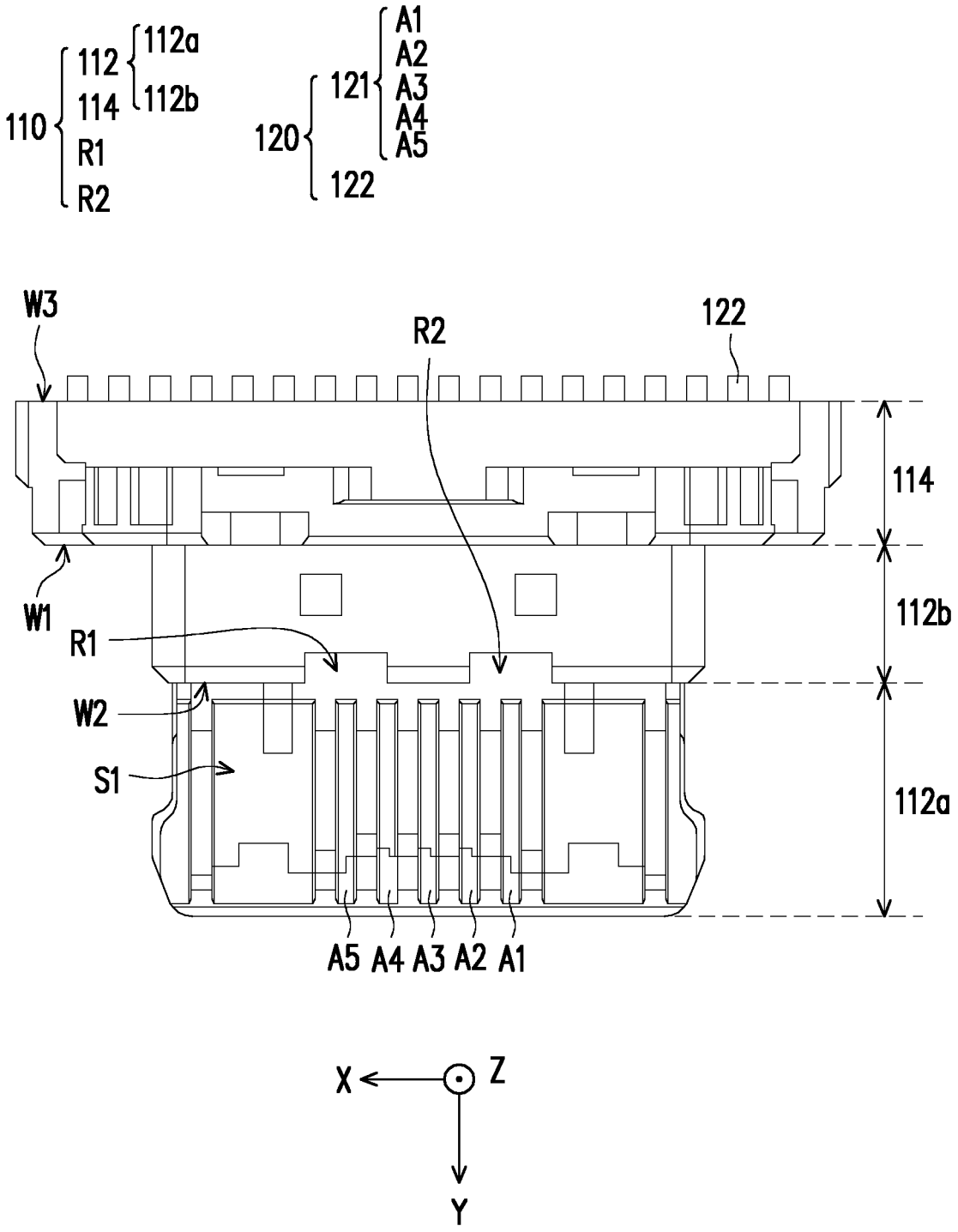
FIG. 4 shows the internal component of the USB connector of FIG. 2 from a top view.

FIG. 4 shows the internal component of the USB connector of FIG. 2 from a top view. Referring to FIG. 2 to FIG. 4, in the present embodiment, the tongue portion 112 of the insulating body 110 and the thickened step portion of the insulating body 110 are further divided into a first area 112*a* and a second area 112*b*, wherein the first area 112*a* covers the tongue portion 112 and the second area 112*b* covers the thickened step portion. The second area 112*b* is located between the base portion 114 and the first area 112*a*. Furthermore, on the Y-axis, the second area 112*b* of the thickened step portion is extended from a sidewall W1 of the base portion 114 toward the positive Y-axis, and the first area 112*a* is extended from a sidewall W2 of the thickened step portion and the second area 112*b* toward the positive Y-axis. A soldering portion 122 of each of the terminals 120 (for example, for being connected to a circuit board or a cable) is extended out of the insulating body 110 from the base portion 114, and a flat portion 121 of each of the terminals 120 (for docking with terminals of another connector) is exposed on the upper surface of the tongue portion 112 or a lower surface of the tongue portion 112 of the insulating body 110 from the first area 112*a* of the tongue portion 112. In other words, the soldering portion 122 of each of the terminals 120 is extended from a sidewall W3 of the base 114 toward the negative Y-axis direction, wherein the sidewalls W1 and W3 are two opposite sidewalls of the base portion 114 along the Y-axis. Furthermore, the recesses R1 to R4 are respectively located at the junction of the first area 112*a* and the second area 112*b*, and are substantially extended from the junction toward the second area 112*b*.

Accordingly, when a plurality of terminals (not shown) of another USB connector (not shown) are respectively adapted to be docked to the terminals 120 along the docking direction, the recesses R1 to R4 are located in the docking direction in order to facilitate the collection of debris produced by terminal friction or foreign objects brought in by the other USB connector. In other words, the other USB connector is docked to the USB connector 100 of the present embodiment toward the negative Y-axis. Therefore, the recesses R1 to R4 are disposed in the docking direction (negative Y-axis direction) and substantially located at the end of the terminal docking path, so that the debris or foreign objects may be smoothly absorbed into the recesses R1 to R4.

Please refer to FIG. 2 and FIG. 3 again. In the present embodiment, the USB connector 100 is, for example, a Type-C connector, and the insulating body 110 has a pair of recesses (i.e., the recesses R1 and R2 located on a same surface S1, and the recesses R3 and R4 located on a same surface S2) on two opposite surfaces S1 and S2 of the tongue portion 112, and the flat portions 121 of the terminals 120 respectively expose the insulating body 110 from the two surfaces S1 and S2. Furthermore, for example, the recesses R1 to R4 of the present embodiment specifically correspond to a terminal A1 and a terminal A5 in terminals A1 to A5, wherein the terminals A1 and A5 are respectively a plurality of power terminals (Vbus) of the Type-C connector. The object of this is that the power terminals are usually the terminals in the terminals 120 passing a larger current, so the tolerance thereof for debris or foreign objects is lower. Therefore, the recesses R1 to R4 correspond to the power terminals, so that once debris or foreign objects are produced during the use of the USB connector 100, the debris or foreign objects produced or brought in may be immediately absorbed into the recesses R1 to R4 in response to the docking action thereof to avoid poor withstand voltage or short circuit to the power terminals. Of course, the present embodiment may also achieve the same dust collection effect for other terminals other than the power terminals via the recesses R1 to R4.

Based on the above, in the embodiments of the invention, the universal serial bus connector is provided with a recess on the tongue portion of the insulating body, and the recess is located in the extending direction of the terminals on the tongue portion, especially in the docking direction with another universal serial bus connector. In this way, for connectors docked to each other, the debris produced by terminal friction or the foreign objects brought in may be further pushed into the recess by the docking action, so that the recess may form a dust collection area for accommodating the debris or foreign objects. In this way, it is possible to prevent these debris or foreign objects from falling on the exposed area of the terminals on the tongue portion, thereby avoiding poor withstand voltage or short circuits of adjacent terminals due to these debris or foreign objects.

What is claimed is:

1. A universal serial bus connector, comprising:

an insulating body having a base portion, a tongue portion and a thickened step portion, wherein the thickened step portion is located on a root region of the tongue portion and adjacent to the base portion; and a plurality of terminals retained in the base portion of the insulating body, wherein a flat portion of each of the terminals is exposed on an upper surface of the tongue portion or a lower surface of the tongue portion, wherein at least one recess is formed on a front portion of the thickened step portion and the recess corresponds to at least one terminal and is located in an extending direction of the corresponding terminal on the tongue portion.

2. The universal serial bus connector of claim 1, wherein the recess corresponds to a power terminal of the terminals.

3. The universal serial bus connector of claim 1, wherein the universal serial bus connector is a Type-C connector, and the insulating body has a pair of recesses on two opposite surfaces of the tongue portion to correspond to a plurality of power terminals (Vbus) of the Type-C connector.

4. The universal serial bus connector of claim 1, wherein the tongue portion and the thickened step portion are divided into a first area and a second area along the extending direction of the terminal, the second area covers the thickened step portion, the flat portion of each of the terminals is exposed on the first area of the tongue portion of the insulating body, and the recess is located at a junction of the first area and the second area.

5. The universal serial bus connector of claim 4, wherein the recess is extended from the junction of the first area and the second area toward the second area.

6. The universal serial bus connector of claim 4, wherein the second area is joined between the base portion and the first area, each of the terminals passes through the base portion, the first area, and the second area, and a portion of each of the terminals is extended out of the insulating body from the base portion.

7. The universal serial bus connector of claim 1, wherein the tongue portion has two surfaces opposite to each other, each of the terminals respectively exposes the insulating body from the two surfaces, and the insulating body has a plurality of recesses respectively located at the two surfaces.

8. The universal serial bus connector of claim 1, wherein a plurality of terminals of another universal serial bus connector are respectively adapted to be docked to each of the terminals along a docking direction, and the recess is located in the docking direction.

9. A universal serial bus connector, comprising:

an insulating body having a base portion and a tongue portion, wherein the tongue portion has two surfaces opposite to each other; and a plurality of terminals retained in the base portion of the insulating body, wherein each of the terminals respectively exposes on the two surfaces, and the insulating body has at least one first recess located at one of the two surfaces and a plurality of second recesses respectively located at the two surfaces, wherein the first recess and the second recesses are departed from each other, wherein the tongue portion is divided into a first area and a second area along the extending direction of the terminal, and the first recess is located at a junction of the first area and the second area, wherein the terminals are retained in and exposed from the second recesses respectively.

10. The universal serial bus connector of claim 9, wherein the first recess corresponds to a power terminal of the terminals.

11. The universal serial bus connector of claim 9, wherein the universal serial bus connector is a Type-C connector, and the insulating body has a pair of the first recesses on two opposite surfaces of the tongue portion to correspond to a plurality of power terminals (Vbus) of the Type-C connector.

12. The universal serial bus connector of claim 9, wherein the insulating body further comprising a thickened step portion, wherein the thickened step portion is located on a root region of the tongue portion and adjacent to the base portion, the second area covers the thickened step portion.

13. The universal serial bus connector of claim 12, wherein the first recess is extended from the junction of the first area and the second area toward the second area.

14. The universal serial bus connector of claim 12, wherein the second area is joined between the base portion and the first area, each of the terminals passes through the base portion, the first area, and the second area, and a portion of each of the terminals is extended out of the insulating body from the base portion.

15. The universal serial bus connector of claim 9, wherein a plurality of terminals of another universal serial bus connector are respectively adapted to be docked to each of the terminals along a docking direction, and the first recess is located in the docking direction.

* * * * *